US007253974B2

(12) United States Patent
Guillermin et al.

(10) Patent No.: US 7,253,974 B2
(45) Date of Patent: Aug. 7, 2007

(54) METHOD FOR TRIMMING A SPECTACLE LENS

(75) Inventors: Laurent Guillermin, Charenton le Pont (FR); Ludovic Jouard, Charenton le Pont (FR)

(73) Assignee: Essilor International (Compagnie Generale d'Optique), Charenton (FR)

( * ) Notice: Subject to any disclaimer, the term of this patent is extended or adjusted under 35 U.S.C. 154(b) by 80 days.

(21) Appl. No.: 10/551,237

(22) PCT Filed: Mar. 24, 2004

(86) PCT No.: PCT/FR2004/000720

§ 371 (c)(1),
(2), (4) Date: Sep. 27, 2005

(87) PCT Pub. No.: WO2004/087373

PCT Pub. Date: Oct. 14, 2004

(65) Prior Publication Data

US 2007/0097525 A1 May 3, 2007

(30) Foreign Application Priority Data

Mar. 27, 2003 (FR) ..... 03 03764

(51) Int. Cl.
*A61B 2/10* (2006.01)

(52) U.S. Cl. ..... 359/819; 351/204; 351/218

(58) Field of Classification Search ..... 359/819; 351/204, 205, 218, 200
See application file for complete search history.

(56) References Cited

U.S. PATENT DOCUMENTS 6,325,697 B1 12/2001 Gottschalk

FOREIGN PATENT DOCUMENTS

EP 0 953 405 11/1999

*Primary Examiner*—Timothy Thompson
(74) *Attorney, Agent, or Firm*—Young & Thompson

(57) ABSTRACT

The invention relates to a method for carrying out the precise trimming of a lens (1), whereby the lens is held between two clamping plates (2, 3) in a given position and the grinding of the periphery of the lens (1) is controlled along a trajectory, the last programmed part of which corresponds to the form (8) desired for the lens. The method comprises a first scanning under weak clamping conditions of a number of points on one face of the lens with scanning of the coordinates of the points (8), forming the trace on said face of the mounting circle, a second scanning, with a significant level of clamping which corresponds to that used on trimming the lens of a second number of points on said face of the lens, an approximate mathematical representation of the face of the lens for each of the two clamping conditions, a calculation of the coordinates for the deformation of the contour of the lens on said face of the lens in the second clamping condition to correct the last programmed part of the grinding trajectory.

8 Claims, 2 Drawing Sheets

METHOD FOR TRIMMING A SPECTACLE LENS

The present invention relates to machining the outline of a lens for spectacles in order to fit the lens to the rim that is to receive it.

BACKGROUND OF THE INVENTION

A lens for spectacles, regardless of whether or not it is a correcting lens, comes from a part possessing all of the optical qualities required for its use, and in particular an optical center referred to as the center of the lens. This part generally has a circular outline of a diameter that is large enough for all possible peripheral shapes corresponding to the immense variety of rims that exist in the spectacle frame market to be inscribed therein.

Trimming is a machining operation which consists in causing the outline of the lens to match the shape of the frame that is to receive it. This peripheral machining makes use of tooling in which the lens is clamped in the vicinity of its center between two accessories for holding it and generally for enabling the lens to be turned about an axis passing through the lens, while the desired outline is obtained using a grinding wheel, generally in two stages.

The lens clamping accessories are in the form of pads which, on being pressed against the concave and convex faces of the lens, give rise to stresses and deformations in the lens. The outline is therefore machined on a deformed lens under stress which, on being released, will take up a shape that is different, and will therefore have an outline that is different from the outline that was machined.

In order to process small lenses of oblong shape while ensuring that the lens is rotated correctly during trimming, it is necessary to use pads of oblong shape. It is not advisable, and is in any event ineffective, to apply strong pressure with a circularly symmetrical pad of small size. Unfortunately, the asymmetrical clamping that results from using oblong pads inevitably gives rise to deformation of the lens.

OBJECT OF THE INVENTION

The present invention seeks to take account of this deformation by improving the process of trimming a lens, in particular by providing a stage in said process in which a correction factor is determined for the outline that is obtained by grinding so that, once the lens returns to the relaxed state, it has been trimmed to the desired outline as imposed by the rim, to within acceptable tolerance.

BRIEF SUMMARY OF THE INVENTION

To this end, the invention thus provides a method of accurately trimming a lens in order to enable it to be mounted in a determined frame rim, in which method the lens is held between two clamping pads in a defined position in a frame of reference associated with the pads, and grinding of the periphery of the lens is controlled along a trajectory whose programmed terminal portion corresponds on the lens to the shape of the outline of the rim. According to the invention, the method comprises:

while the lens is in a lightly clamped condition, taking first measurements of a plurality of points on a face of the lens;

while the lens is in a tightly clamped condition, as is required for trimming the lens, taking second measurements of another plurality of points on said face of the lens;

on the basis of the above measurements, making an approximate mathematical representation of the above-mentioned face of the lens in each of the two clamping conditions;

using the above mathematical representations to calculate the coordinates of the transformed points of the trace of the programmed shape of the rim on said face of the lens, said transform being the result of the lens being deformed in compliance with a model obtained on passing from the first clamping condition to the second; and correcting each of the points of the programmed milling trajectory by an amount defined by the difference between the programmed coordinates and the calculated coordinates.

It is by making use of the mathematical representations of a face of the lens that it is possible to correct the trimming trajectory. It is only by a mathematical representation of said face or of a plurality of lines on said face that it is possible to obtain the values of the coordinates of a point that does not move on said face but that moves together with the face in the frame of reference of the workstation when clamping conditions are changed. It is then possible to form models representing the physical reality of the phenomena generated by changing the clamping force. For example, it is possible to consider that the change in shape takes place without any change in surface area on the face that is subjected to measurements (the face that has been traced by a feeler), such that the arc on said face connecting the point under consideration to a center of the lens is of identical length for both clamping conditions. If this point belongs to the outline of the lens, i.e. to the programmed shape of the rim in the frame of reference, it constitutes the point of coordinates known by calculation through which the grinding wheel must pass to perform trimming while the lens is deformed by the clamping. These coordinates referenced relative to the coordinates of an ideal trajectory corresponding to trimming a lens that is not deformed, enable a correction coefficient to be determined for said ideal trajectory.

In preferred manner, the coordinates of points on the deformed face are measured after roughing out has been performed. The deformation of the lens under the effect of the clamping varies with the quantity of material involved, and in particular with the dimension of the lens in the radial direction. Thus, for identical clamping force applied to the center of the lens, deformation of the lens is found to be different depending on whether its periphery is close to or far from the center.

In a simplified implementation of the invention, the mathematical representation of the shape of the face of the lens is in the form of a mathematical approximation to the shape of at least one meridian arc of the lens, i.e. a line on the surface of the lens (e.g. its convex surface) which extends from the center of the lens to an arbitrary point of said surface (this could be referred to as an arc of a great circle between the center and the point under consideration), and in particular to a point of the outline programmed for the rim of the lens in its non-deformed state. More precisely, in this simplified implementation of the method of the invention, the first measurements are performed by using a feeler to trace points on the above-mentioned face of the lens along at least one meridian arc, in a zone adjacent to the above-mentioned trace of the rim, in order to determine a mathematical approximation to the shape of said meridian arc, the second measurement relating to points of the same meridian arc that has already been traced in order to determine a mathematical approximation to the shape of said arc, correlated with the first approximation, with the above-mentioned calculation and correction consisting in calculating the values for coordinates of the point of the meridian arc belonging to the programmed outline of the rim in the mathematical representation of the meridian arc under deforming stress, and in correcting the terminal portion of the trajectory of the grinding wheel by a coefficient taken from the difference between the programmed coordinates and the calculated coordinates for said point of intersection.

Mention is made above of the assumption whereby the traced face deforms between its two clamping conditions with area that remains constant, i.e. without any lengthening or shortening of any surface dimension. Other models can be envisaged, such as for example the model whereby the deformation of the lens between two clamping states takes place at constant area on an imaginary internal surface containing the "neutral fibers" of the lens, with the convex face of the lens then being subjected to lengthening relative to said "neutral surface", while its concave face is subjected to shortening. This lengthening can be quantified and taken into account when calculating the corrections.

It should be observed that, in the above, the programmed outline of the rim (or the ideal trajectory for the grinding wheel that is to make the outline) corresponds in reality to a cylindrical envelope having generator lines extending parallel to the clamping axis of the lens and touching said outline. In other words, in the above, no account is taken of the coordinates of each point of said outline along said axis of said generator lines. In order to be complete, the trimming of a lens requires a portion in relief to be made on the edge face of the lens (either an indentation for receiving a tie band of the rim or a projection for penetrating into the groove in the rim). This portion in relief is obtained by the shape of the edge face of the grinding wheel which therefore needs to be positioned along the above-mentioned direction so as to keep it always facing the edge face of the lens. To enable such control to be performed accurately, it is therefore appropriate to measure the coordinates of points on the projection of the programmed outline onto the lens, and in particular the coordinate along the clamping axis for each of said points. This measurement can be performed in one or other of the clamping conditions of the lens and by performing calculation on the basis of said measurement and of the mathematical representations of the traced surface of the lens, thereby determining parameters for controlling position along the clamping direction in order to take account of the deformation of the lens while it is being trimmed. These parameters are additional to those which, as mentioned above, determine the final trajectory of the grinding wheel during control of the machine.

Other characteristics and advantages of the invention appear from the following description of an implementation of the method of trimming a lens for spectacles given by way of non-limiting example.

BRIEF DESCRIPTION OF THE DRAWINGS

Reference is made to the accompanying drawings, in which.

DETAILED DESCRIPTION OF THE INVENTION

Figure 1:
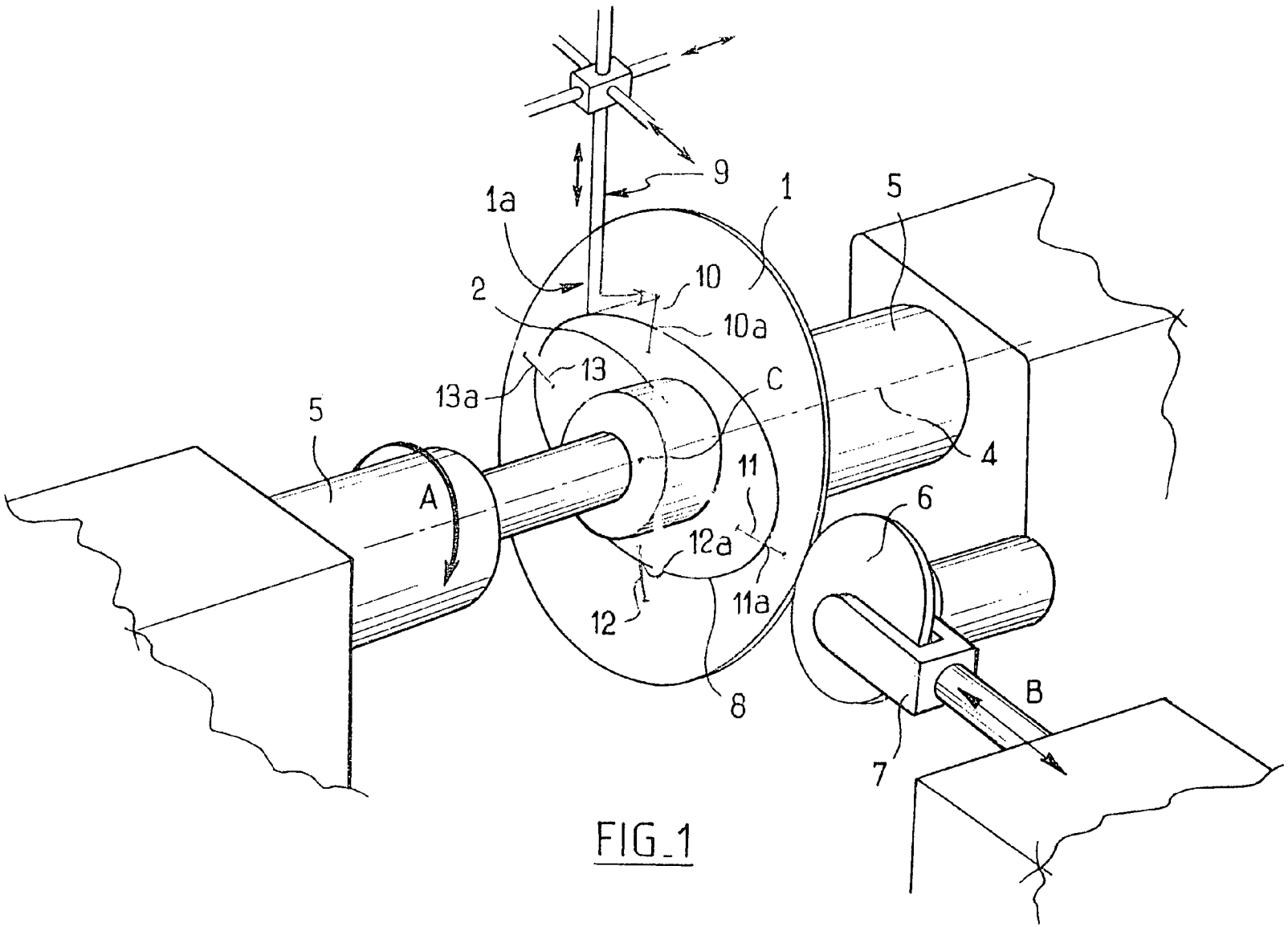
FIG. 1 is a diagram showing apparatus for trimming a lens for spectacles.

In conventional manner, and as shown in the figures, a substantially circular lens 1 is clamped between two pads 2 and 3 so as to be capable of being rotated about an axis 4 which passes through the center C of the lens 1. The pads 2 and 3 are fitted to conventional clamping actuators 5, one of which is rotated about the axis 4 in the direction A.

A grinding wheel 6 for trimming the lens is carried by a support 7 capable of moving away from and towards (arrow B) the axis 4 in application of a program defined by the outline 8 that is to be obtained, and naturally also by the angular displacement of the lens about the axis 4.

The trimming device further comprises a feeler unit 9 suitable for obtaining the coordinates, in the reference system of the apparatus, of a plurality of points, e.g. belonging to the convex face 1*a* of the lens 1. In particular, the feeler device 9 can trace the coordinates of points belonging to the outline 8 that is to be obtained, i.e. to the trace of the outline of the rim on the face 1*a* of the lens 1 while it is subjected to no stress, i.e. under a condition of light clamping between the pads 2 and 3, as shown in portion 2A of FIG. 2. It thus enables the coordinates of arcs such as 10, 11, 12, and 13 to be traced, which arcs are orthogonal meridian arcs extending in the vicinity of the above-mentioned trace 8. The meridians 10, 12 and 11, 13 intersect at the point of intersection between the convex face 1*a* of the lens and the axis 4 passing through the center C.

If the material constituting the lens 1 is sufficiently rigid and/or if the thickness of the lens is sufficiently great, then a clamping force can be applied thereto that leads to practically no stresses and thus to practically no deformation of the lens. Under such conditions, trimming is performed conventionally, i.e. by the grinding wheel 6 being programmed to move relative to the axis 4 progressively towards the profile 8, which profile has previously been entered into the machine by the periphery of the selected rim, and thus of the lens, being copied into the frame of reference of the machine. Under such circumstances, the feeler device 9 serves to specify the coordinate along the axis 4 of each point of the final outline of the lens in order to control the position of the grinding wheel along said axis so as to make a portion in relief on the edge face of the lens.

However, in most cases, the clamping force from the pads leads to the lens being deformed by an amount that is not negligible compared with the shape of said lens when not clamped. It will be understood from portion 2B of FIG. 2 that if the above-explained procedure were to be applied to the deformed lens, then once the clamping force has been released from the lens, an outline 8' would be obtained that does not correspond to the desired outline 8. The lens would be too big.

The invention consists in a method enabling the desired profile to be obtained by trimming the deformed lens under stress. To do this, a plurality of points are picked up on two meridian arcs 10, 12 and 13, 11 while the lens is lightly clamped so that it is not deformed. These measurements are made using the feeler device 9, and the coordinates of the points that are known in the reference system of the apparatus shown in FIG. 1 enable a mathematical representation to be obtained in said reference system of the meridians, one of which comprises the arcs 10 and 12 and the other the arcs 11 and 13. By way of example, this mathematical representation may be a circle constituting one of the great circles of the convex surface 1*a* of the lens if the lens is spherical or it may be a mathematical approximation in the form of a fourth degree polynomial, for example. It has been found that this refinement suffices for the accuracy that is desired in the dimensions of the lenses that are to be obtained.

With this mathematical representation of two meridians (or more meridians if so desired, it being understood that the taking of measurements consumes times and that a good compromise needs to be found between the accuracy to be achieved and the time spent to obtain it), it is easy to calculate the length that exists, for example, between the center C through which the two meridians pass and the points of intersection 10*a*, 11*a*, 12*a*, and 13*a* between said meridians and the trace 8 of the outline to be made.

By making the assumption that the lengths of these meridians do not vary during deformation of the lens (i.e. that the deformation is surface deformation in which area is conserved, and thus linear deformation in which length is conserved), it is known that the final edge of the trimmed lens, on each meridian, will be distant from the center of the lens by a length of arc that is equal to the calculated length. Thus, if a new measurement is taken of the arcs such as 10, 11, 12, and 13 on the outside face 1*a* of the lens while it is deformed under the effect of a large clamping force that is required to enable it to be machined, and as shown in portion 2B of FIG. 2, it is possible to find a new mathematical representation of these meridians, expressed for example in the form of the equation of a circle or a polynomial (once more of degree four). Then by constraining said equations to values which correspond to the previously calculated lengths of arc, it is possible to find the coordinates in the frame of reference of the trimming tooling for the points where the grinding wheel is to pass in order to ensure that the final result, once the lens has been released from the compression stresses, is for the edge of the lens to coincide with the above-mentioned trace 8. This calculated point is referenced 8" in portion 2B of FIG. 2, thus making it possible to determine the value E by which the control of the grinding wheel needs to be modified compared with the programming that was originally prepared for the grinding wheel on the assumption that the lens is undeformed and undeformable.

In this context, it should be observed that the above-mentioned programming in fact corresponds to defining a terminal portion of a trajectory between the grinding wheel and the lens caused to rotate A about the axis 4; the other portion (the initial portion) of this trajectory is the result of approach programming.

The description above relates to feeling two meridians and obtaining a mathematical representation thereof. A correction is thus obtained for each of four points of the outline. However, it should be understood that the outline needs to be corrected over its continuous length. Several methods are then available for obtaining a correction coefficient for each of the points of the outline. A first such method consists in linear interpolation between each of the values E obtained in register with the meridians that have been traced. This method gives good results when the lens possesses concave and convex faces that are surfaces of revolution about the axis 4.

When the concave face is cylindrical or toroidal, the lens is no longer a body of revolution about the axis passing through its center, and linear interpolation between the four measured points can turn out to be of insufficient accuracy. Under such circumstances, in the deformed state shown in portion 2B of FIG. 2, in addition to tracing the meridian arcs, the feeler device 9 is also used to trace the trace 8 on the lens in its second clamping condition, thus making it possible to determine a relationship (non-linear interpolation) for variation in the correction coefficient between the two measured meridians.

Figure 2:
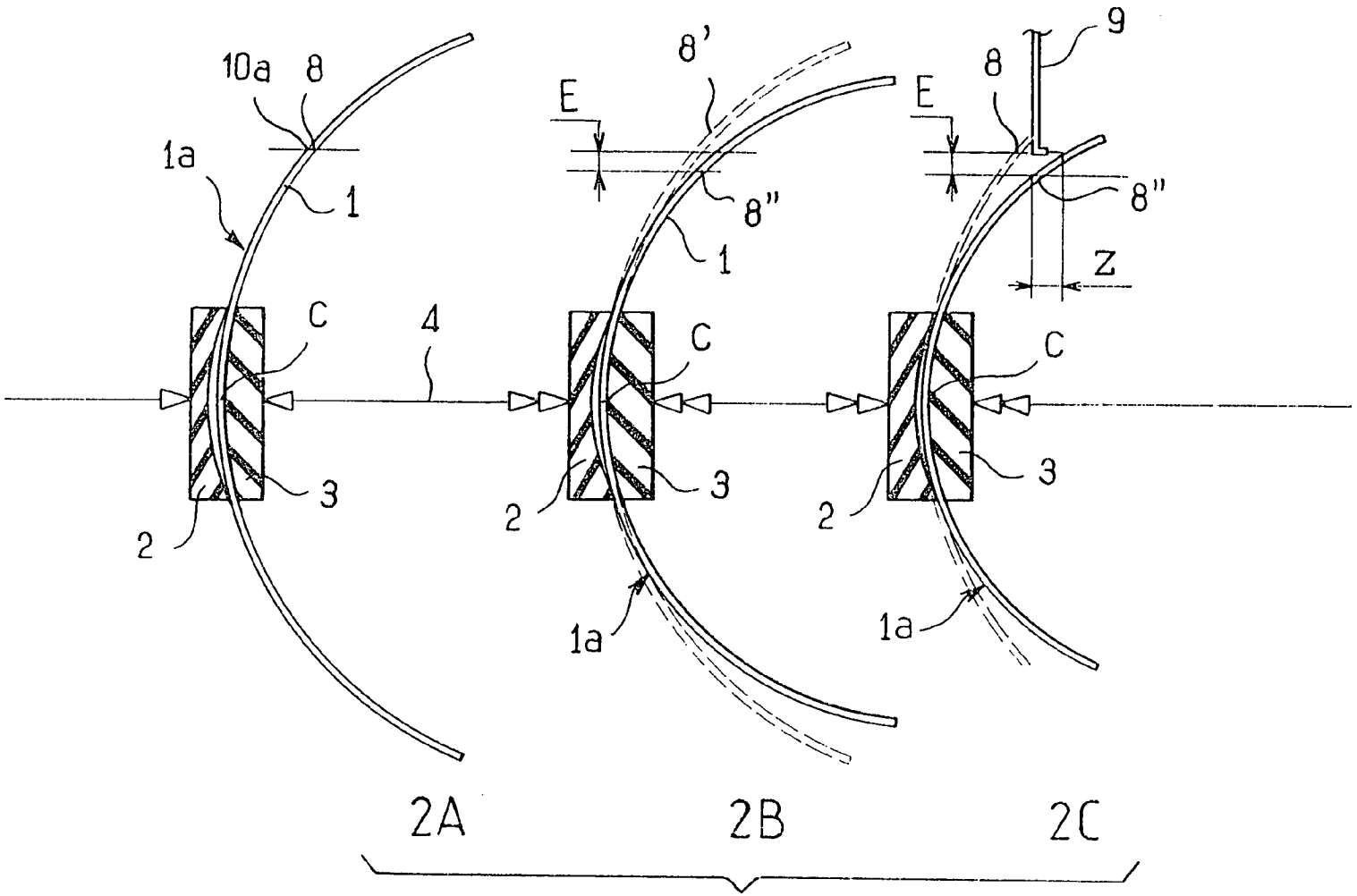
FIG. 2 is a diagram showing the various stages of the method of the invention.

A refinement of the method of the invention consists in taking measurements on the lens while it is deformed by strong pressure between the pads 2 and 3, after roughing out the lens. As can be seen in FIG. 1, depending on the outline 8 to be obtained, it may be necessary to remove a large amount of material from the periphery of the lens. For given clamping force, removing this material modifies the way in which the lens is deformed such that measurements taken prior to any grinding, as in portion 2B of FIG. 2, can be different from measurements taken after roughing out the part, and can thus lead to a mathematical representation of the lens that is not representative of the real state of the lens at the end of trimming, thus leading to erroneous correction of the grinding trajectory. Portion 2C of FIG. 2 shows the lens 1 after it has been subjected to roughing out. The second feeling operation on the meridian arcs, for example, is performed on the lens as roughed out in this way, with the drawback that the meridian arcs are no longer very long, particularly outside the final outline, which can lead to reduced accuracy in the mathematical approximation to the shapes. Nevertheless, it has been found that in spite of the lack of space enabling sufficiently numerous measurements to be taken to obtain a good mathematical approximation, the final outline that is obtained is much closer to the desired outline than when the feeling operation is performed on the lens while it is deformed as shown in portion 2B of FIG. 2. In portion 2C of FIG. 2, there can be seen the same references as those used previously for designating elements that are identical.

In portion 2C of FIG. 2, there can be seen the feeler 9 following the theoretical programmed trajectory corresponding to the outline 8 of the rim on the lens in its second clamped position, the measurements being in the frame of reference of the lens. It can be seen that the place where feeling is performed does not correspond to the corrected trajectory, which leads to a positioning error for the grinding wheel along the direction of the axis 4, with this error having the consequence of a portion in relief being incorrectly placed on the edge face of the lens. The mathematical representation of the lens in both clamping states enables a correction Z to be applied to the measurements taken that enable the edge face of the lens to be machined correctly.

The invention claimed is:

1. A method of accurately trimming a lens in order to enable it to be mounted in a determined frame rim, in which method the lens is held between two clamping pads in a defined position in a frame of reference associated with the pads, and grinding of the periphery of the lens is controlled along a trajectory whose programmed terminal portion corresponds on the lens to the shape of the outline of the rim, the method comprising:

while the lens is in a lightly clamped condition, taking first measurements of a plurality of points on a face of the lens;

while the lens is in a tightly clamped condition, as is required for trimming the lens, taking second measurements of another plurality of points on said face of the lens;

on the basis of the above measurements, making an approximate mathematical representation of the above-mentioned face of the lens in each of the two clamping conditions;

using the above mathematical representations to calculate the coordinates of the transformed points of the trace of the programmed shape of the rim on said face of the lens, said transform being the result of the lens being deformed in compliance with a model obtained on passing from the first clamping condition to the second; and correcting each of the points of the programmed milling trajectory by an amount defined by the difference between the programmed coordinates and the calculated coordinates.

2. A method according to claim 1, wherein the first measurements comprise tracing points of said face belonging to at least one meridian arc in a zone adjacent to said trace, including the point of intersection between said meridian arc with said trace, in order to determine a mathematical approximation of the shape of said meridian arc, wherein the second measurements comprise tracing points of the meridian arc as already traced in order to determine a mathematical approximation to the shape of said arc in correlation with the first approximation, and wherein the above-mentioned calculation and correction consists in calculating the values of the coordinates of the point of intersection between the trace and the meridian arc in the mathematical representation of the meridian arc under deforming stress and in correcting the terminal portion of the trajectory of the grinding wheel by a coefficient derived from the difference between the measured coordinates and the calculated coordinates for said point of intersection.

3. A method according to claim 1, wherein the second measurement is taken after a stage of roughing out the lens.

4. A method according to claim 2, wherein the mathematical approximation is a polynomial approximation.

5. A method according to claim 2, wherein the meridian arcs are traced along four arcs that are offset by 90° about the center of the lens.

6. A method according to claim 5, wherein the above-mentioned correction coefficient for each point of the trajectory situated between two adjacent traced meridian arcs is implemented by linear interpolation.

7. A method according to claim 1, including tracing the rim on the above-mentioned face of said lens.

8. A method according to claim 5, including tracing the rim on the above-mentioned face of said lens, and wherein the above-mentioned correction coefficient for the trajectory between two adjacent felt meridian arcs is determined by an interpolation formula, itself determined from data measured while tracing said trace of the rim.

* * * * *